US006850598B1

(12) United States Patent
Fryda et al.

(10) Patent No.: US 6,850,598 B1
(45) Date of Patent: Feb. 1, 2005

(54) X-RAY ANODE AND PROCESS FOR ITS MANUFACTURE

(75) Inventors: Matthias Fryda, Braunschweig (DE); Lothar Schafer, Meine (DE); Thorston Matthee, Meine (DE)

(73) Assignee: Fraunhofer Gesellschaft zur Förderung der angewandten Forschung e.V., München (DE)

( * ) Notice: Subject to any disclaimer, the term of this patent is extended or adjusted under 35 U.S.C. 154(b) by 84 days.

(21) Appl. No.: 10/030,133

(22) PCT Filed: Jul. 24, 2000

(86) PCT No.: PCT/EP00/07076

§ 371 (c)(1),
(2), (4) Date: Mar. 19, 2002

(87) PCT Pub. No.: WO01/08195

PCT Pub. Date: Feb. 1, 2001

(30) Foreign Application Priority Data

Jul. 26, 1999 (DE) ..... 199 34 987

(51) Int. Cl.[7] ..... H01J 35/24
(52) U.S. Cl. ..... 378/161; 378/140; 378/143
(58) Field of Search ..... 378/131, 140, 378/143, 119, 122, 161

(56) References Cited

U.S. PATENT DOCUMENTS 4,159,437 A * 6/1979 Sahores ..... 313/59
4,583,243 A 4/1986 Diemer et al. ..... 378/143
4,622,688 A * 11/1986 Diemer et al. ..... 378/143
5,173,612 A * 12/1992 Imai et al. ..... 250/505.1
5,258,091 A 11/1993 Imai et al. ..... 156/613
5,809,106 A * 9/1998 Kitade et al. ..... 378/132
6,103,401 A * 8/2000 Okada et al. ..... 428/634
6,185,277 B1 * 2/2001 Harding ..... 378/143
6,241,651 B1 * 6/2001 Smith et al. ..... 600/1
6,359,968 B1 * 3/2002 Harding ..... 378/143
6,366,639 B1 * 4/2002 Ezaki et al. ..... 378/34

FOREIGN PATENT DOCUMENTS

DE 19544203 6/1997
EP 432568 6/1991 ..... H01J/35/08
EP 676772 10/1995 ..... G21K/1/10

* cited by examiner

*Primary Examiner*—Craig E Church
*Assistant Examiner*—Irakli Kiknadze
(74) *Attorney, Agent, or Firm*—Greenblum & Bernstein, P.L.C.

(57) ABSTRACT

The invention relates to an x-ray anode and a process for its manufacture. The x-ray anode is characterized in that the anode material is embodied as a layer on a diamond window. The x-ray anode is preferably used with x-ray units which require as selective as possible x-radiation production to achieve as high as possible radiation intensity. Use in x-ray microscopes in which a high radiation intensity guarantees the highest resolutions is particularly preferred.

28 Claims, 1 Drawing Sheet

X-RAY ANODE AND PROCESS FOR ITS MANUFACTURE

CROSS-REFERENCE TO RELATED APPLICATIONS

Figure 1:
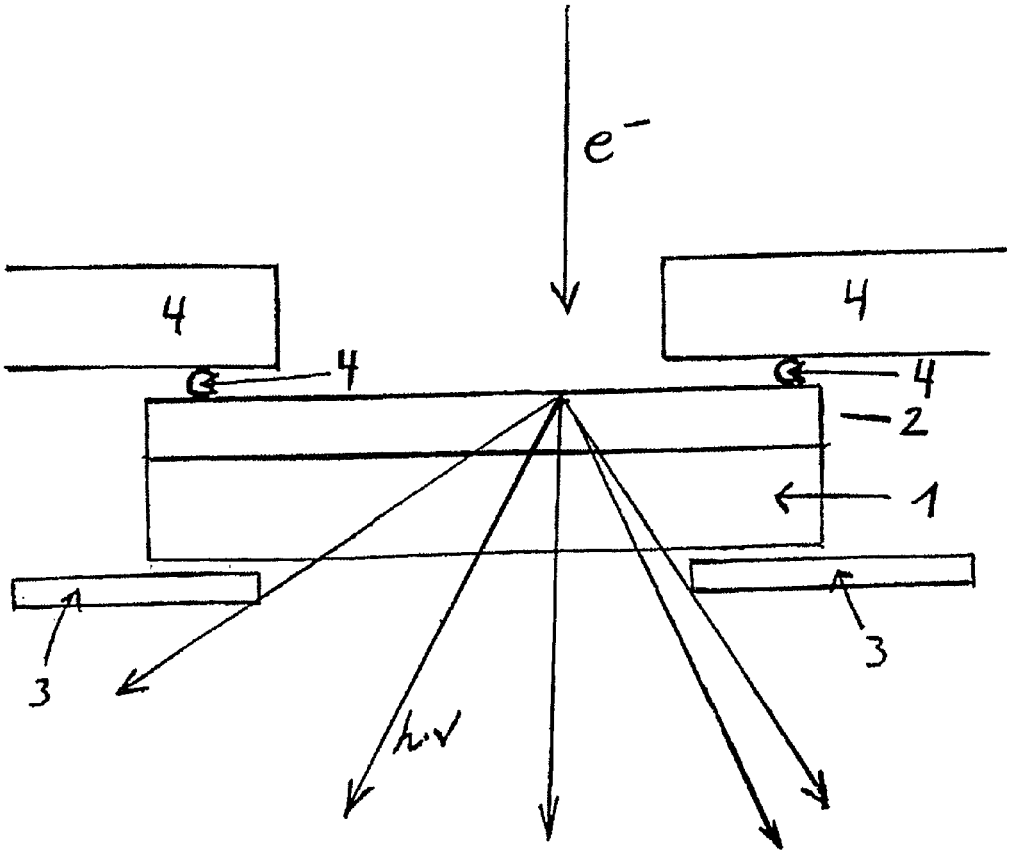

The present application claims is a U.S. National Stage of International Application No. PCT/EP00/07076 filed Jul. 24, 2000 and claims priority under 35 U.S.C. §119 of German Patent Application No. 199 34 987.8 filed Jul. 26, 1999.

BACKGROUND OF THE INVENTION

1. Field of the Invention

The invention relates to an x-ray anode and a process for its manufacture. The x-ray anode according to the invention is preferred for use in x-ray units where the highest possible x-radiation is necessary. It is particularly preferred for use with x-ray microscopes in which a high radiation intensity guarantees the highest resolutions.

2. Discussion of Background Information

In x-ray production, metallic anode material is usually irradiated with electrons. The radiation caused by characteristic electronic transitions exits the apparatus through a window transparent for x-rays. In order to avoid absorption, X-ray production results here at low gas pressures. The transparent window serves to separate the low pressure area from the outside area.

Metallic x-ray anodes made of e.g., copper or molybdenum, and a beryllium window in a target angle arrangement are known. There is a certain spacing between the anode and the beryllium window here and they are tilted towards one another. If the x-radiation produced is used for x-ray microscope purposes, this solution has the disadvantage of the resolution being only quite small because of the unavoidable ray divergence between the anode and the object to be imaged. Beryllium is also highly toxic and should therefore be avoided as far as possible as a window material.

As an alternative to beryllium windows as x-ray exit windows for x-ray units, U.S. Pat. No. 5,173,612 suggests using a diamond window a few 10 $\mu$m thick. However, since thicker diamond windows are ruled out because of increased absorption by diamond, these thin diamond windows cause considerable mechanical problems. Thin diamond windows can hardly withstand the pressure differential of approximately $10^5$ Pa between the low pressure area and the outside area and have to be stabilized by appropriate crosspieces at considerable cost.

Also known are so-called microfocus sources, where the anode material forms a layer on a beryllium window and where the anode is bombarded by an electron beam as strongly focussed as possible. In the case of these microfocus sources, the anode moves closer to the object in optical imaging and the optical resolution can be increased. The more sharply the electron beam bombarding the anode is focussed on the anode, the better the resolution. Disregarding diffractions, a spot focus on the anode would be ideal. However, with a spot focus the problem arises that the energy generated by the electron bombardment causes the material to melt or evaporate, thus reducing its operating life. A thicker anode must be selected to compensate for the evaporation of anode material. However, a thick anode results in the x-radiation being absorbed by the anode material itself. The use of a thicker beryllium window is ruled out for the same reason. Moreover, this solution has the considerable disadvantage that mechanical problems can occur due to the existing pressure differentials, and the microfocus source can easily burst. However, this is particularly harmful in the case of toxic beryllium, where a rupture of the microfocus source leads to undesirable apparatus down-time because of the safety measures for staff protection then required. For these reasons according to prior art spot focussing is possible only to a limited extent.

DESCRIPTION OF THE INVENTION

The invention is based on the technical problem of producing an x-ray anode that avoids the disadvantages of the prior art as far as possible. The x-ray anode needs to be harmless from a health viewpoint and, in particular, should make it possible to work with a much smaller focus than with the prior art.

The solution of this technical problem is achieved through an anode material being located on a diamond window. The process-related task of producing such an x-ray anode includes coating an auxiliary layer with a diamond layer by chemical vapor deposition (CVD), and depositing a metallic layer on the diamond layer. Advantageous embodiments are provided in the dependent claims.

According to the invention it was recognized that the problems could be solved by an x-ray anode where the anode material is on a diamond window.

At first, diamond seems unsuitable as a material for a microfocus source. With an atomic number of Z=6, diamond absorbs x-radiation more than beryllium at Z=4. It would therefore be expected that the diamond windows used would have to be thinner than beryllium windows, entailing the above-mentioned mechanical problems. Moreover, up until now, only beryllium was considered as a window material, since beryllium is a rollable metal from which it is easy to make beryllium windows. According to the prior art, this window serves as a substrate for a metal anode to be applied.

However, it has been possible to prove with experiments that these disadvantages could be overcompensated by a diamond substrate. Contrary to expectations, it is possible to work with a much smaller focus with an x-ray anode on a diamond window than it is with an x-ray anode on a beryllium window. The reason for the overcompensation is that diamond is an excellent heat conductor, so the thermal energy produced can be dissipated with particular efficiency through the diamond substrate. The focal spot therefore heats up less and it is possible to decrease the focus diameter. This leads, as desired, to greater radiation densities. Conversely, exchanging a diamond window for the beryllium window with the same beam density and operating life renders possible a thinner anode with lower absorption of x-radiation.

It bas been shown that even relatively thick diamond layers can be used advantageously with very thin anodes. In this context, diamond windows are also suitable with thicknesses of between 50 $\mu$m and 1000 $\mu$m, or still better between 300 $\mu$m and 700 $\mu$m. With such thicknesses, an efficient removal of heat and a good mechanical stability is guaranteed.

According to the present invention, a polycrystalline diamond substrate or diamond window can be used, as well as a monocrystal window. A polycrystalline diamond substrate can be produced particularly simply by means of chemical vapor deposition (CVD), e.g., by hot-filament CVD or microwave CVD. This also makes it possible to produce larger diamond substrates at moderate prices. The deposition of the anode material takes place through a different deposition process, e.g., physical vapor deposition (PVD).

Basically, metals, several layers of metal, or metal alloys can be considered as anode material. The thickness of the anode material should preferably be in the range of between 1 μm and 25 μm, even better in the range of between 3 μm and 12 μm, and best of all at 6 μm.

The layers do not need to feature constant thicknesses. This means that, e.g., in the case of a disk-shaped microfocus source, the disk thickness does not need to be uniform. The disk can have, e.g., a greater thickness at the edge. The thicknesses given above for the layers should therefore be understood to refer to thicknesses in the focal spot.

In order to ensure that there is always sufficient anode material on the diamond, and that it has not evaporated after a certain number of hours in operation, a temperature sensor can be provided for the x-ray anode according to the invention. A creative possibility here is using the diamond window as a thermistor, i.e., exploiting the temperature dependence of the electrical resistance of the diamond window. After the appropriate calibration, the user has only to set the optimal operating point regarding the desired radiation intensity with a minimal evaporation rate. This makes it easier to avoid thermally-conditioned damage to the x-ray anode according to the invention. Even in the event that part of the anode material has evaporated after a certain number of hours in operation, the diamond window, as an uncommonly thermally stable material, will usually be completely intact. In this case, the remaining anode material can be chemically removed and the diamond window can be recoated in the course of maintenance work. Choosing diamond as a window material thus renders possible a cost-efficient overhaul of the x-ray anode according to the invention, while simultaneously reusing the diamond window.

In its simplest embodiment, the anode material is found holohedrally on the diamond substrate. Depending on the special features of production or of the planned use for the microfocus source, however, it can be sufficient for only part of the diamond layer to be covered by the anode material. Depending on the adhesion of the anode material to the diamond substrate, it can be sufficient to apply the anode material directly on the diamond layer. However, in the case of poor adhesion, an adhesion-promoting intermediate layer can be advantageous. An intermediate layer can likewise be advantageous when as far as possible monochromatic radiation needs to be emitted from the x-ray anode. In this case, the intermediate layer acts as a radiation filter and/or a monochromator.

Tests have further shown that, with the same radiation output, temperature-sensitive samples can be better examined with the x-ray anode according to the invention than with the comparison anode with a beryllium window. Due to the excellent thermal conduction of diamond, the temperatures on the side facing the atmospheric area are lower, which makes it possible to place the samples closer to the window. This in turn results in a better optical resolution.

An exemplary embodiment of the invention is described in greater detail below:

A polycrystalline diamond layer 1 with a thickness of 250 μm is deposited on an auxiliary substrate using hot-filament CVD. After removing the auxiliary substrate, a tungsten layer 2 with a thickness of 6 μm is deposited on this diamond layer using physical vapor deposition (PVD). The tungsten layer covers the diamond layer completely. The x-ray source is mounted in the housing 4 of a commercial x-ray microscope by a clamp 3, with sealing washers 5 being used to ensure a stable vacuum. The Figure shows this microfocus source in installed condition. X-radiation hν is produced by localized bombardment of the x-ray anode with electrons $e^-$. The maximum achievable radiation density is measured with this x-ray anode. If the diamond layer is replaced with a 500 μm thick beryllium layer under otherwise identical conditions, the radiation density of the x-radiation produced is reduced by a factor of 4. With a diamond layer thickness of likewise 500 μm, the radiation density achievable with the x-ray anode according to the invention would be even better, due to the improved heat dissipation.

What is claimed is:

1. An x-ray anode for microfocus sources comprising:

a diamond window having a thickness in a range of 300 μm to 2000 μm;

an anode material being located on said diamond window.

2. The x-ray anode in accordance with claim 1, wherein said diamond window comprises a polychrystalline diamond window.

3. The x-ray anode in accordance with claim 1, wherein said diamond window is a monocrystal.

4. The x-ray anode in accordance with claim 1, wherein said anode material comprises at least one of a metal, an alloy, and a plurality of layers of metal.

5. The x-ray anode in accordance with claim 1, wherein said anode material has a thickness between 1 μm and 25 μm.

6. The x-ray anode in accordance with claim 1, wherein said anode material has a thickness between 3 μm and 12 μm.

7. The x-ray anode in accordance with claim 1, wherein said anode material has a thickness of 6 μm.

8. The x-ray anode in accordance with claim 1, wherein said anode material at least partially covers said diamond window.

9. The x-ray anode in accordance with claim 1, wherein said anode material completely covers a surface of said diamond window.

10. The x-ray anode in accordance with claim 1, wherein said anode material only partially covers a surface of said diamond window.

11. The x-ray anode in accordance with claim 1, further comprising an intermediate layer positioned between said anode material and said diamond.

12. The x-ray anode in accordance with claim 11, wherein said intermediate layer comprises an adhesion-promoting layer.

13. The x-ray anode in accordance with claim 11, wherein said intermediate layer comprises a radiation filter.

14. The x-ray anode in accordance with claim 1, further comprising a temperature sensor.

15. The x-ray anode in accordance with claim 1, wherein said diamond window is structured and arranged as a temperature sensor.

16. The x-ray anode in accordance with claim 1, wherein said x-ray anode is structured and arranged for use in an x-ray microscope.

17. The x-ray anode in accordance with claim 1, wherein said x-ray anode is structured and arranged for use in an x-ray unit.

18. The x-ray anode in accordance with claim 1, wherein said anode material comprises tungsten.

19. The x-ray anode in accordance with claim 1, wherein said anode material is located on said diamond window by physical vapor deposition.

20. The x-ray anode in accordance with claim 1, wherein said diamond layer is formed on an auxiliary substrate by chemical vapor deposition.

21. An x-ray anode formed by a process comprising:

locating an anode material on a diamond window having a thickness in a range of 300 $\mu$m to 2000 $\mu$m.

22. The x-ray anode in accordance with claim 21, wherein said anode material is located on said diamond window by physical vapor deposition.

23. The x-ray anode in accordance with claim 21, wherein, before the anode material is located on said diamond window, said process further comprises:

forming said diamond window by depositing a polycrystalline diamond layer onto an auxiliary substrate; and removing the auxiliary substrate from the diamond window.

24. The x-ray anode in accordance with claim 23, wherein said polycrystalline diamond layer is deposited on said auxiliary substrate by chemical vapor deposition.

25. The x-ray anode in accordance with claim 21, wherein said anode layer at least partially covers a surface of said diamond window.

26. A method of making an x-ray anode, the method comprising:

forming a diamond window with a thickness of between 300 $\mu$m to 2000 $\mu$m, wherein the diamond window includes an inner surface and an outer surface; and applying an anode material onto at least a portion of the inner surface.

27. The method of claim 26, wherein, before the applying, the method further comprises applying an intermediate layer onto said diamond window.

28. The method of claim 27, wherein the intermediate layer is an adhesion-promoting intermediate layer.

* * * * *